US005655847A

United States Patent [19]

Kobayashi et al.

[11] Patent Number: 5,655,847

[45] Date of Patent: Aug. 12, 1997

[54] BALL-POINT PEN

[75] Inventors: Seiichi Kobayashi; Kazuhiko Furukawa, both of Yokohama, Japan

[73] Assignee: Mitsubishi Pencil Kabushiki Kaisha, Tokyo, Japan

[21] Appl. No.: 334,182

[22] Filed: Nov. 3, 1994

[30] Foreign Application Priority Data

| | | | |
|---|---|---|---|
| Dec. 6, 1993 | [JP] | Japan | 5-071096 U |
| Mar. 16, 1994 | [JP] | Japan | 6-070168 |

[51] Int. Cl.[6] ..... B43K 7/10; B43K 7/00

[52] U.S. Cl. ..... 401/219; 401/214

[58] Field of Search ..... 401/214, 219

[56] References Cited

U.S. PATENT DOCUMENTS

| | | | |
|---|---|---|---|
| 2,249,163 | 7/1941 | Nissen, Jr. | 401/214 X |
| 3,554,660 | 1/1971 | Woods | 401/214 |
| 3,792,932 | 2/1974 | Henriksen . | |
| 4,976,564 | 12/1990 | Fukuoka et al. . | |
| 5,277,510 | 1/1994 | Okamoto et al. | 401/214 |

FOREIGN PATENT DOCUMENTS

| | | | |
|---|---|---|---|
| 176302 | 3/1953 | Austria | 401/214 |
| 0 548 600 A1 | 6/1993 | European Pat. Off. . | |
| 1012842 | 7/1952 | France | 401/214 |
| 1059164 | 3/1954 | France | 401/219 |
| 1212583 | 3/1960 | France | 401/214 |
| 1049738 | 1/1959 | Germany | 401/214 |
| 1277703 | 9/1968 | Germany | 401/214 |
| 7243796.8 | 3/1973 | Germany . | |
| 82 06 611.6 | 11/1982 | Germany . | |
| 42 00 964 C1 | 8/1993 | Germany . | |
| 473463 | 7/1952 | Italy | 401/219 |
| 52067 | 12/1992 | Japan . | |
| 53987 | 12/1992 | Japan . | |
| 2078175 | 1/1982 | United Kingdom | 401/219 |

*Primary Examiner*—Steven A. Bratlie
*Attorney, Agent, or Firm*—Darby & Darby

[57] ABSTRACT

A ball-point pen of the present invention is provided which includes: a ball-point pen refill being accommodated in the barrel cylinder and having: a tip with a tip ball held at the front end thereof; an ink reservoir which stores low-viscosity oily ink and has an ink follower provided in the rear end of the ink; and a joint disposed between the tip and the ink reservoir. The joint further includes: a valve chamber holding a ball valve in its inside and communicating with the rear end of the tip; and a ball valve seat disposed on the rear side of the valve chamber for the ball valve in order to prevent backward flow of ink. With this configuration, it is possible to provide a ball-point pen which, without need of any cap, can create dense writing traces free from blotting and unevenness even when a low viscosity oily ink is used.

11 Claims, 11 Drawing Sheets

BALL-POINT PEN

BACKGROUND OF THE INVENTION (1) Field of the Invention

The present invention relates to a ball-point pen having an improved ball-point pen refill mounted therein whose writing tip may project and retract from the barrel of the ball-point pen. More specifically, the present invention is directed to a ball-point pen having a ball-point pen refill equipped with ink leak-preventing mechanisms for preventing forward and backward ink leakage when low-viscosity oily ink is employed.

(2) Description of the Prior Art

The present applicant has disclosed a back leak-preventing mechanism in Japanese Utility Model Publication Hei 4 No.52067 in which prevention of backward leakage of ink is effected by providing a valve chamber having a ball valve put therein with play. This disclosure provides a ball-point pen in which a plastic mouthpiece made of a synthetic resin having a required number of projecting ribs is provided so that the ball is held therein with play and may not slip out and, upon writing, ink flows to a tip through channels formed between the projecting ribs.

Conventionally known ball-point pens can be categorized into two types, one of which is a so-called oil type ball-point pen that uses a high-viscosity ink. The other is a so-called water type ball-point pen which includes sliver fibers holding ink therein and an ink feeder that leads ink from the fibers to the tip of the ball-point pen.

The ink of the conventionally known oil type ball-point pen has high viscosity, therefore, when the ball-point pen is used for writing, only a small amount of the ink can flow out as a tip ball rotates. Further, the ball-point pens of this type have defects such as ink-blotting, unevenness of writing traces, low writing density, requirement of high writing pressure and the like.

In contrast, water type ball-point pens use more costly materials since the water type ball-point pen uses sliver fibers for keeping the ink. Additionally, the water type ball-point pen has a drawback that consumption of ink cannot be known.

Under these circumstances, in order to solve the drawbacks of both types of the ball-point pens, a water type ball-point pen has been presented which uses water-type thixotropic ink (or having shear viscosity decreasing property) that has relatively low viscosity for canceling the defect of oil type ball-point pens and exhibits high viscosity at static state but lowers its viscosity at writing due to the rolling of the ball to thereby allow easy flow-out of ink.

However, as to the ball-point pen using such thixotropic ink, the ink of this type tends to flow out in a large amount in order to enhance the writing density and therefore the ink reservoir is made large in diameter so that it can store a large amount of ink.

Additionally, the ink having thixotropy has another defect, that is, the ink is easy to dry. Therefore, it is necessary to provide a cap especially for sealing the writing tip.

Alternatively, in order to solve the problems, use of oily ink having low viscosity and resistance to dryness might be used, but the ink of this type also tends to flow out in a large amount and in order to lengthen the life of the pen, the ink reservoir is made large in diameter so that it can store a large amount of ink.

In addition, since the viscosity of the thixotropic ink is low as compared to that of the conventional ink for oil type ball-point pens, the flow resistance of the ink in question against the wall of the ink reservoir is small. Accordingly, the ink is liable to leak backward to the rear end of the ink reservoir due to self-weight of the ink, knocking or falling impacts. To deal with this drawback, the rear end of the ink in the reservoir is generally provided with a greasy ink follower which moves following the consumption of ink during writing and inhibits the back leaking of ink which would be brought about by self-weight of ink or outside impacts. However, even with the provision of the ink follower, if the ink immediately below the tip ball is used up when the writing is performed with the pen upward, the head or pressure of the ink acts directly on the ink follower, causing notable backward leakage of ink. Besides, when the ink reservoir is made with a large inside diameter and length so as to increase the reserve amount of ink, it becomes difficult to regulate the backward flow phenomenon caused by outside impacts. Once ink leaks backward, the ink not only pollutes the barrel inside but also leaks out through the vent disposed in the barrel to pollute the user's hands and clothes. It is true that oil type ball-point pens also suffer from the backward flow phenomenon of ink but the phenomenon occurs more apparent in the case of the ball-point pens using thixotropic ink.

To make matters worse, since the ink has low viscosity and tends to flow out in a large amount, any gap between the tip ball and tip ball holding portion causes ink to ooze out (in the forward direction) from the tip when the tip is oriented downward. Further, after the pen is used to write with its tip upward or after the pen undergoes knocking impact or falling impact, the ink immediately below the tip ball tends to be drawn backward, so that subsequent writing becomes unclear.

SUMMARY OF THE INVENTION

It is therefore an object of the present invention to provide a ball-point pen having a ball-point pen refill using oily ink presenting excellent resistance to dryness, wherein any leakage, that is, forward leakage of ink as well as backward leakage of ink which would occur when the pen is used for writing with its tip up or receives knocking or falling impacts, can be inhibited thereby preventing pollution of the barrel inside of the ball-point pen, user's hands, clothes and the like.

Another object of the present invention is to provide a ball-point pen that prevents unclear traces of writing caused by allowing air to pass immediately behind the tip ball when the pen is used for writing with its tip up or when the pen receives some outside impacts or which is caused by dryness of the tip ball due to imperfect sealing between the tip ball and the inside edge of the tip holding portion.

In accordance with a first aspect of the present invention, a ball-point pen is provided which comprises: a barrel cylinder for holding a ball-point pen refill; and a ball-point pen refill which is accommodated in the barrel cylinder and includes: a tip with a tip ball held in a holding portion at the front end thereof; an ink reservoir which stores low-viscosity oily ink having excellent resistance to dryness and has an ink follower provided in 5 the rear end of the ink; and a joint disposed between the tip and the ink reservoir and having an inside hollow, the joint comprising: a valve chamber loosely holding a ball valve therein and communicating with the rear end of the tip; a ball valve seat disposed on the rear side of the valve chamber for hermetically seals the ball valve chamber in order to prevent backward flow of ink; and a conduit disposed on the rear side of the ball valve seat for communicating between the valve chamber and the ink reservoir.

In accordance with the second aspect of the present invention, a ball-point pen is provided which comprises: a barrel cylinder for holding a ball-point pen refill; and a ball-point pen refill which is accommodated in the barrel cylinder and includes: an ink reservoir which stores low-viscosity oily ink having excellent resistance to dryness and has an ink follower provided in the rear end of the ink; and a tip with a tip ball held in a holding portion at the front end thereof, further having a spring thereinside which continuously urges the tip ball so as to bring the tip ball into intimate contact with the inside edge of the ball holding portion at the front end of the tip, and is constructed such that, at the time of writing, the tip ball is pressed inward opposing to the resiliency of the spring whereby the intimately contacting state between the tip ball and the ball holding portion is released to allow ink to flow out.

In accordance with the third aspect of the present invention, a ball-point pen is provided which comprises: a barrel cylinder for holding a ball-point pen refill; and a ball-point pen refill which is accommodated in the barrel cylinder and includes: a tip with a tip ball held in a holding portion at the front end thereof, further having a spring thereinside which continuously urges the tip ball so as to bring the tip ball into intimate contact with the inside edge of the ball holding portion at the front end of the tip; an ink reservoir which stores low-viscosity oily ink having excellent resistance to dryness and has an ink follower provided in the rear end of the ink; and a joint disposed between the tip and the ink reservoir and having an inside hollow, the joint comprising: a valve chamber loosely holding a ball valve therein and communicating with the rear end of the tip; a ball valve seat disposed on the rear side of the valve chamber for hermetically sealing the ball valve in order to prevent backward flow of ink; and a conduit disposed on the rear side of the ball valve seat for communicating between the valve chamber and the ink reservoir, and is constructed such that, at the time of writing, the tip ball is pressed inward opposing to the resiliency of the spring whereby the intimately contacting state between the tip ball and the ball holding portion is released so as to allow ink to flow out.

DESCRIPTION OF THE PREFERRED EMBODIMENTS

Figure 1:
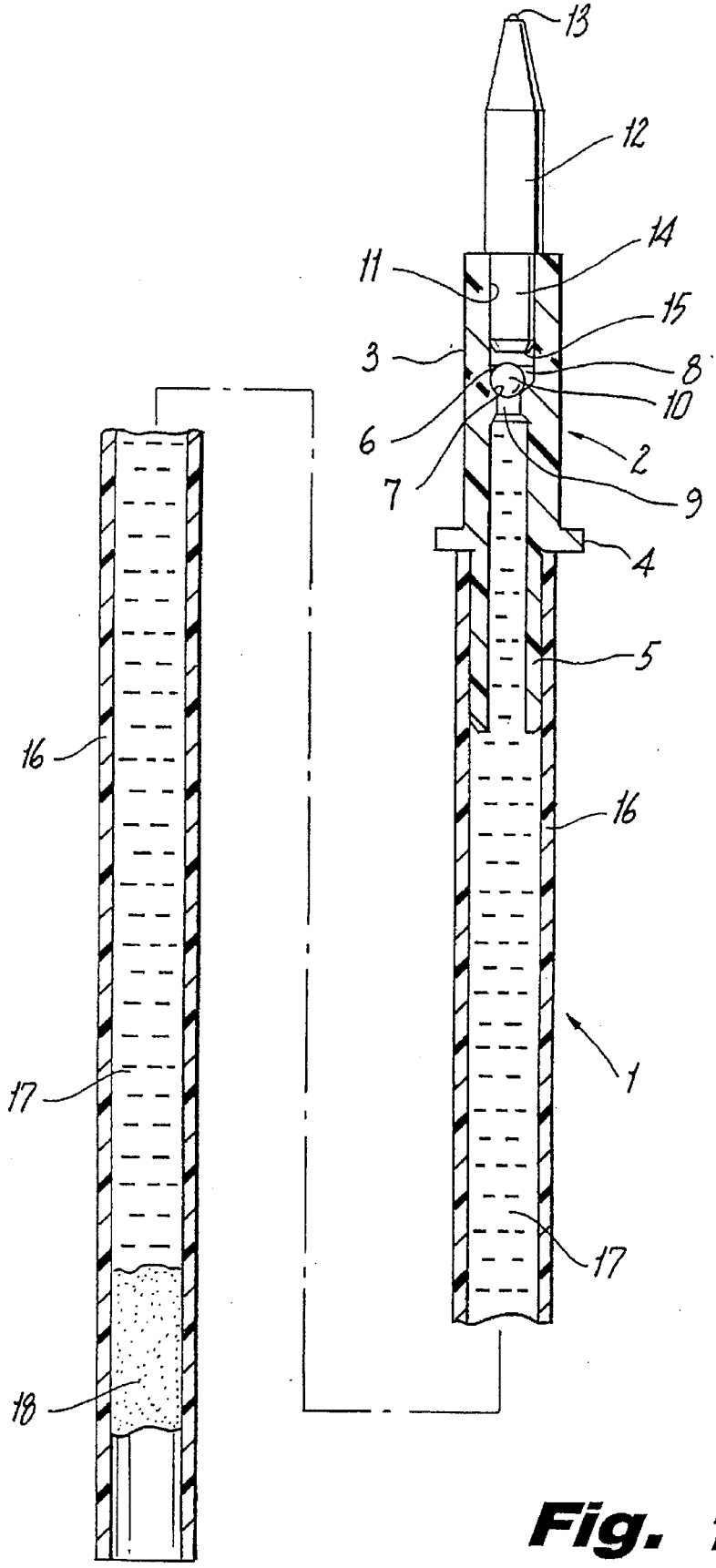
FIG. 1 is a vertical sectional view showing an overall feature of a ball-point pen refill with its tip oriented upward in accordance with a first embodiment of the invention.
Figure 2:
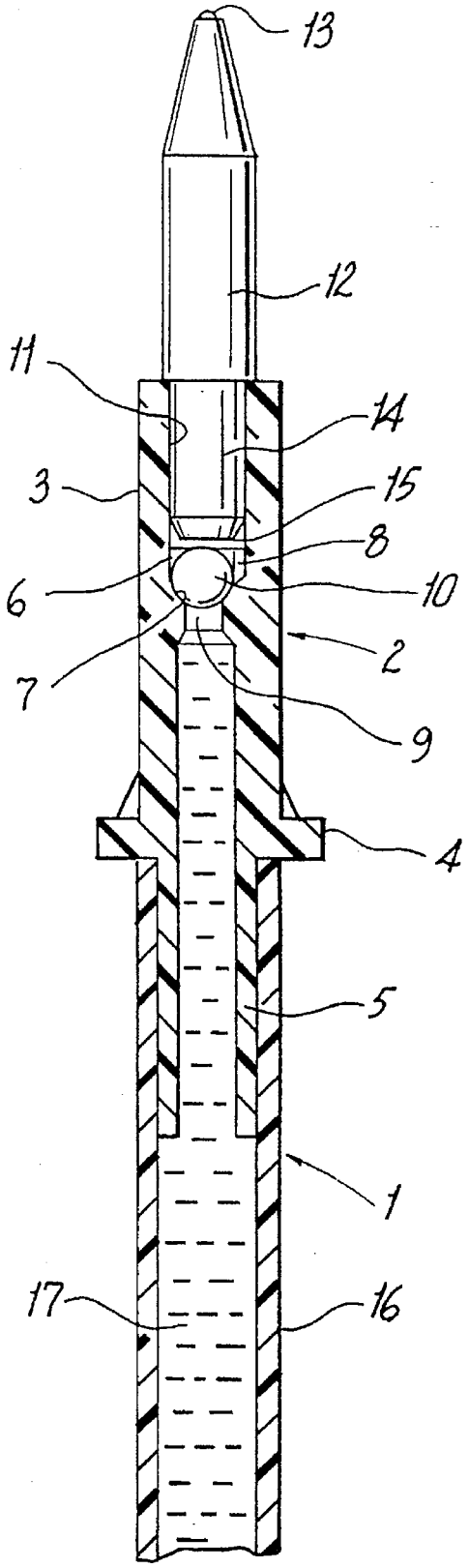
FIG. 2 is a vertical sectional view of essential parts showing a front part of the ball-point pen refill shown in FIG. 1.

FIGS. 1 and 2 show a ball-point pen refill 1 used in the present invention. The refill 1 includes a joint 2 composed of a front pipe portion 3 and a rear pipe portion 5 with a flange-like step portion 4 therebetween. A squeezing pipe portion 14 of a tip 12 holding a tip ball 13 at the front end thereof is secured in an inside hollow 11 in the front end of the front pipe portion 3.

The joint 2 is integrally formed by a synthetic resin and the like, and a valve chamber 6 is formed in the rear of the inside hollow 11. Provided on the rear end of the valve chamber 6 is a frustoconical ball valve seat 7. The valve chamber 6 is made eccentric or offset, relative to the inside hollow 11 while being contained within a range of the circumference of the inside hollow 11. Further, the valve chamber 6 is provided with a groove 8 at a site on the side wall thereof and loosely holds a ball valve 10 therein. On the rear of the valve chamber 6, a conduit 9 connected from the ball valve seat 7 is formed. In the above configuration, modifications can be allowed as long as the rear end hole of the tip 12 into which ink flows is arranged eccentric or offset in a proper manner relative to the idly held ball valve 10.

The rear pipe portion 5 is extended from the rear of the step portion 4 of the joint 2. A tubular ink reservoir 16 is tightly fitted on the outside periphery of the rear pipe portion 5 with its front end abutting against the rear side of step portion 4. Therefore, the hollow of the ink reservoir 16 is communicated with the conduit 9 of the joint 2. The ink reservoir 16 is filled oily ink 17 having thixotropy which presents high viscosity at static state when it is kept in the ink reservoir 16 and presents decreased viscosity as the tip ball rolls at writing so as to allow the ink to smoothly flow out. Further, a greasy ink follower 18 is filled in contact with the rear end surface of the ink 17 and moves following the consumption of the ink 17. Here, the ink reservoir 16 is formed by, for example, a transparent PP resin molding and the like.

Hence, as shown in FIGS. 1 and 2, when the tip 12 is oriented upward, the ball valve 10 is placed on the ball valve seat 7 in the valve chamber 6 to hermetically close the conduit 9. As a result, even if the pen is used for writing with its tip up and the ink immediately below the tip ball 13 in the tip 12 is used up, the ball valve 10 functions as a backward-flow preventing valve so that the ink head is prevented from acting downward thereby preventing backward leakage of ink. More clearly, if the pen without any ball valve for preventing backward-flow is used for writing with its tip oriented upward, the air enters the tip from the clearance between the tip ball and the edge of the tip ball holder and consequently, the ink flows backward and leaks due to the self-weight of ink. On the contrary, according to the present invention, since the ball valve partitions the ink space into the upper and lower spaces by the ball valve, the ink below the ball valve is suspended and will not flow down to leak. In other words, if the ink below the ball valve would move downward or flow rearward of the pen, a negative pressure arises and acts on the topmost end of the ink and this prohibits the movement of the ink below the ball valve. On the other hand, when the pen is used for writing with its tip 12 oriented downward, the ball valve 10 abuts offset on one side of a rear edge 15 of the tip 12 and therefore ink is allowed to flow through the groove 8 formed on the other side into the tip 12. Hence, the ink 17 delivered from the ink reservoir 16 through the conduit 9 and stored in the valve chamber 6 is lead through the groove 8 up to the tip ball 13 in the tip 12. The ink 17 presents high viscosity at static state, but viscosity of the ink 17 is decreased as the tip ball 13 rolls and therefore the ink 17 flows out in a proper amount to create dense writing traces free from blotting.

Figure 3:
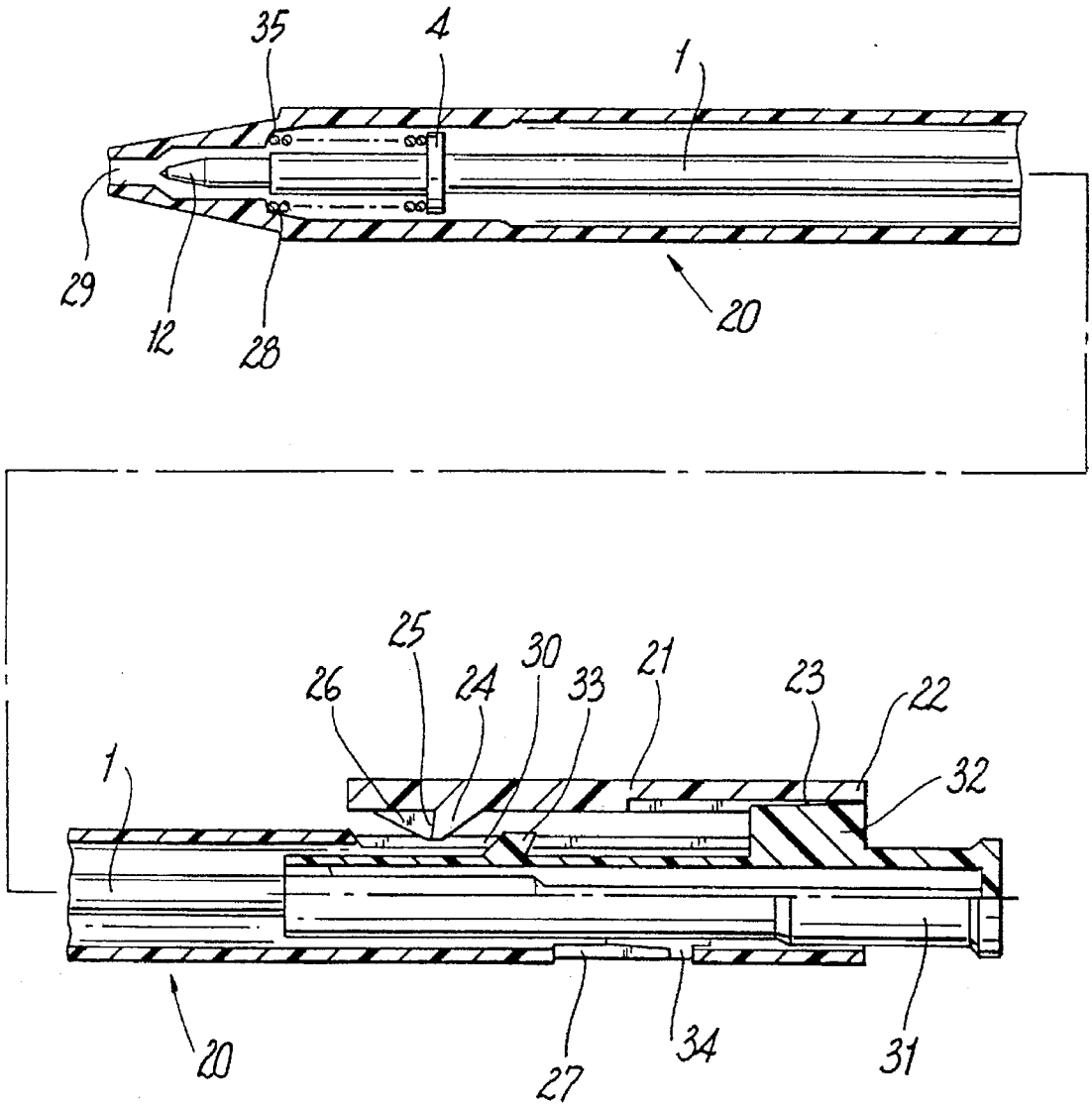
FIG. 3 is a vertical sectional view of essential parts showing an overall feature of a ball-point pen with its writing tip retracted in accordance with an embodiment of the invention.
Figure 4:
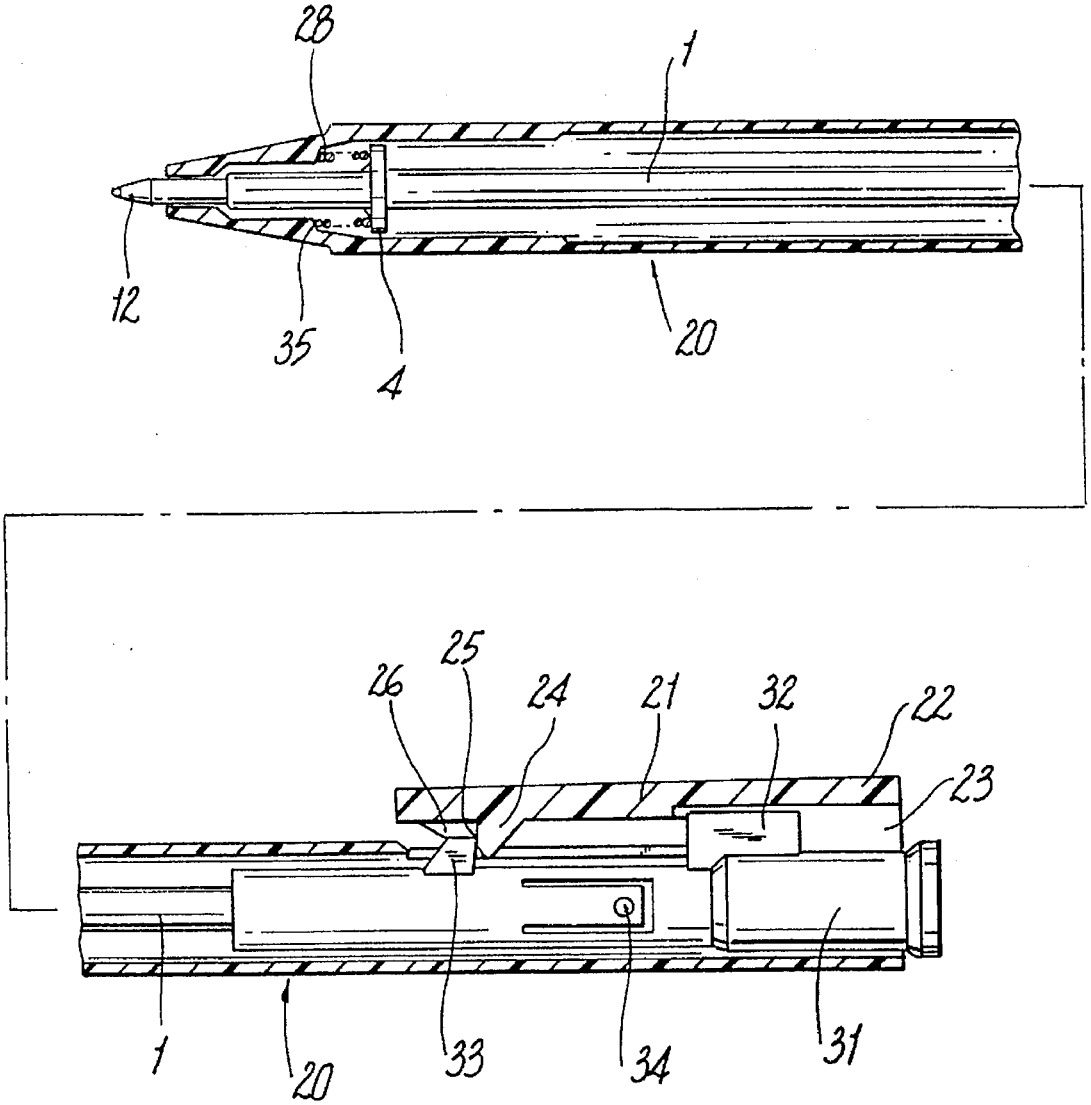
FIG. 4 is a vertical sectional view of essential parts showing an overall feature of a ball-point pen with its writing tip protected in accordance with the same embodiment shown in FIG. 3.
Figure 5:
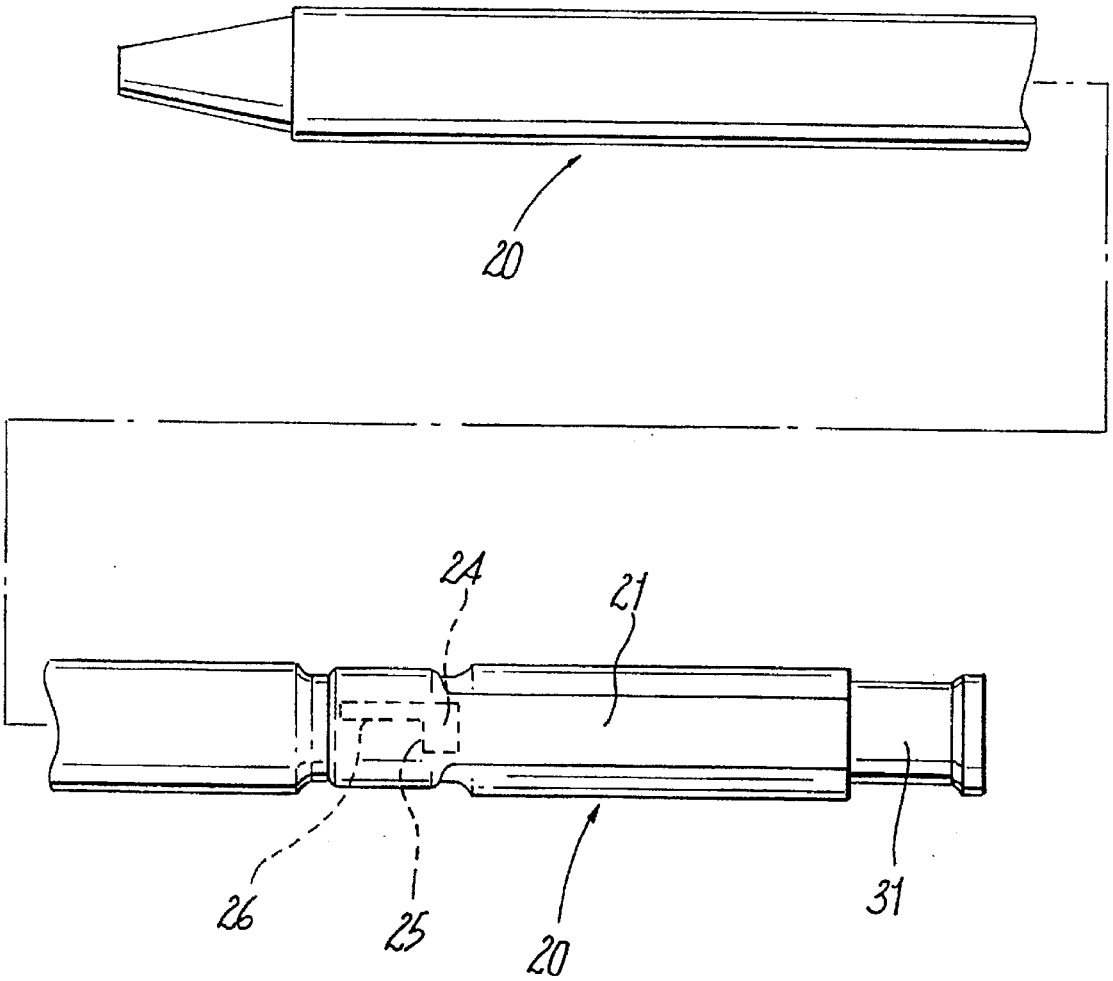
FIG. 5 is a plan view showing an appearance of the ball-point pen shown in FIG. 3.

FIGS. 3 to 5 show a knocking type ball-point pen to which the ball-point pen refill described above can be mounted. Since this ball-point pen is basically similar to the knocking type writing implement disclosed in Japanese Utility Model Publication Hei-4 No.53987, only main features and different points will be described hereinafter.

A barrel cylinder 20 is integrally formed with a clip 21 and has a slit 30 on the side thereof facing the clip 21. The clip 21 has an attachment leg 22 equipped with grooves 23 which connect to both sides of the slit 30. Further, a bead 24 having a hook-shaped catching step 25 and a side wall 26 is provided near the distal end of the clip 21. This catching step 25 engages with an engaging projection 33 of an after-mentioned knock member 31 and the clip 21 is adapted to be resiliently displaced in the lateral directions by a distance that is enough to release the engagement. Further, another window hole 27 is formed on the side of the barrel cylinder 20 separately from the slit 30. The barrel cylinder 20 integrally including all the elements is composed of a transparent resin molding. Examples of the transparent resin used here include polystyrene, ABS, polyester resins and mixtures of these materials.

The knock member 31 has the engaging projection 33 on the side surface thereof and a stopper piece 32 lied on the same line. In addition to the engaging projection 33, another engaging projection 34 which is resiliently displaceable is provided on another line on the side surface of the knock member 31.

The ball-point pen refill 1 is inserted into the inside hollow of the barrel cylinder 20 with the rear end of a coil spring 35 abutted against the step portion 4 and the front end of the coil spring 35 abutting against an inside step portion 28 formed inside the barrel cylinder 20. The knock member 31 covering the rear part of the ball-point pen refill 1 is attached from the rear end of the barrel cylinder 20. Upon the attachment, the engaging projection 33 of the knock member 31 is passed through the Grooves 23 so as to come out through the slit 30 while the stopper piece 32 is located in the Grooves 23 in the attachment leg 22. At the same time, the knock member 31 is urged rearward but stopped by the engaging projection 34 which comes out through the window hole 27 and is caught by the edge of the window hole 27.

As stated above, FIG. 3 shows the state in which the ball-point pen refill 1 is accommodated in the barrel cylinder 20. When the knock member 31 is knocked on the rear end thereof, the tip 12 comes out from a barrel front end opening 29 as shown in FIG. 4 while the engaging projection 33 engages with the catching step 25. In this state, if the distal end of the clip 21 is resiliently displaced in the lateral directions by pressing it toward the side of the side wall 26, the catching step 25 is disengaged from the engaging projection 33 so that the knock member 31 returns to the state shown in FIG. 3. Alternatively, if the ball-point pen in the state shown in FIG. 4 is put into a breast pocket by hooking the clip 21, the catching step 25 is raised so that the engagement with the engaging projection 33 is set free so that the tip 12 retracts into the inside of the barrel cylinder 20 from the barrel front end opening 29. As a result, even if the user carelessly puts the pen with its tip exposed into a pocket and the like, there is no fear to pollute his or her clothes. In a case where used ball-point pen refill 1 is to be replaced with a new one, the ball-point pen refill 1 can be taken out together with the knock member 31 when the engaging projection 34 is disengaged from the window hole 27 of the barrel cylinder 20 by pressing inward the engaging projection 34 of the knock member 31.

As seen from the embodiment, in the ball-point pen refill, the valve chamber idly holding a ball valve therein is disposed in an intermediate portion communicating between the tip and the ink reservoir and the greasy ink follower is provided at the rear end of ink so that the ink in the refill, even if it is of thixotropic one, will not leak back if the refill undergoes knocking impacts or if the pen is used for writing with its tip up. As a result it is possible to provide a ball-point pen of knocking type and the like, which allows its writing tip to project and retract at the front barrel opening and can create dense writing traces free from blotting.

Figure 6:
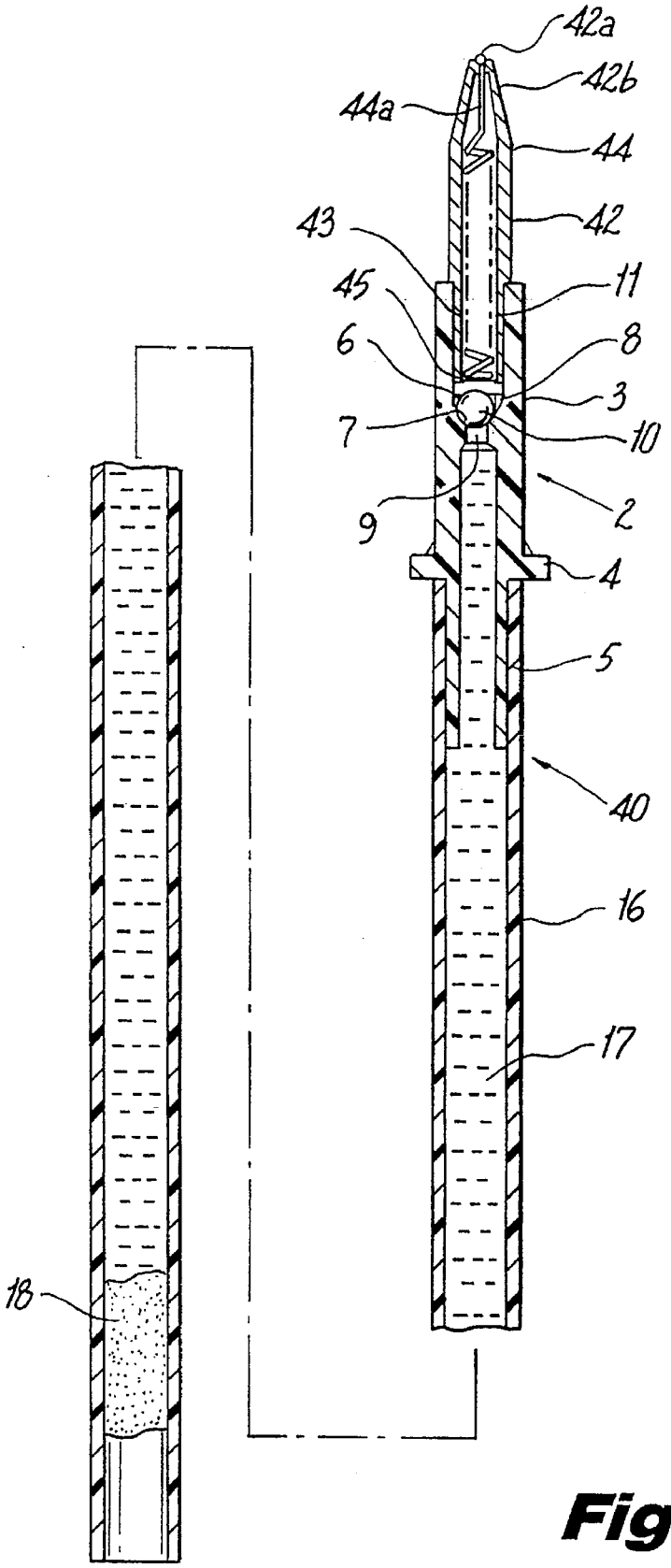
FIG. 6 is a vertical sectional view showing an overall feature of a ball-point pen refill with its tip oriented upward in accordance with a second embodiment of the present invention.
Figure 7:
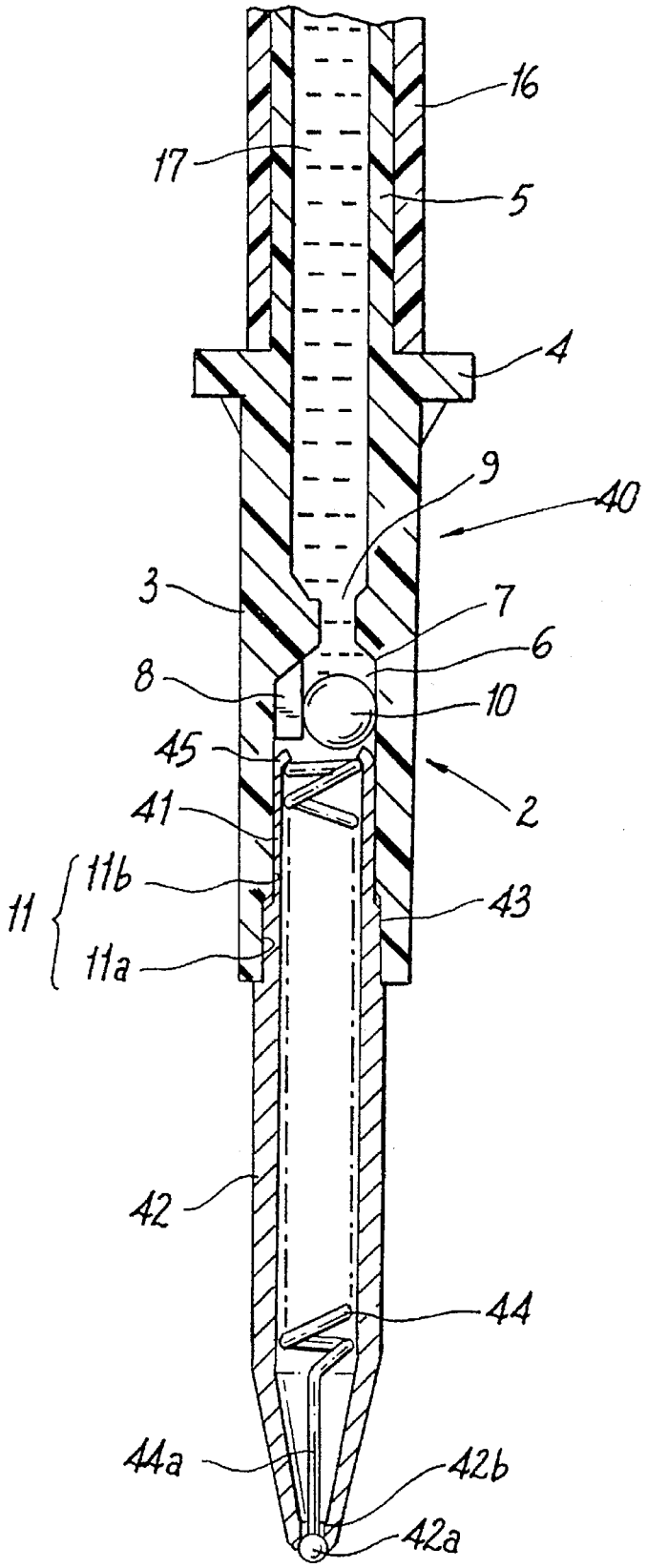
FIG. 7 is a vertical sectional view of essential parts showing a front part of the ball-point pen refill shown in FIG. 6.
Figure 8:
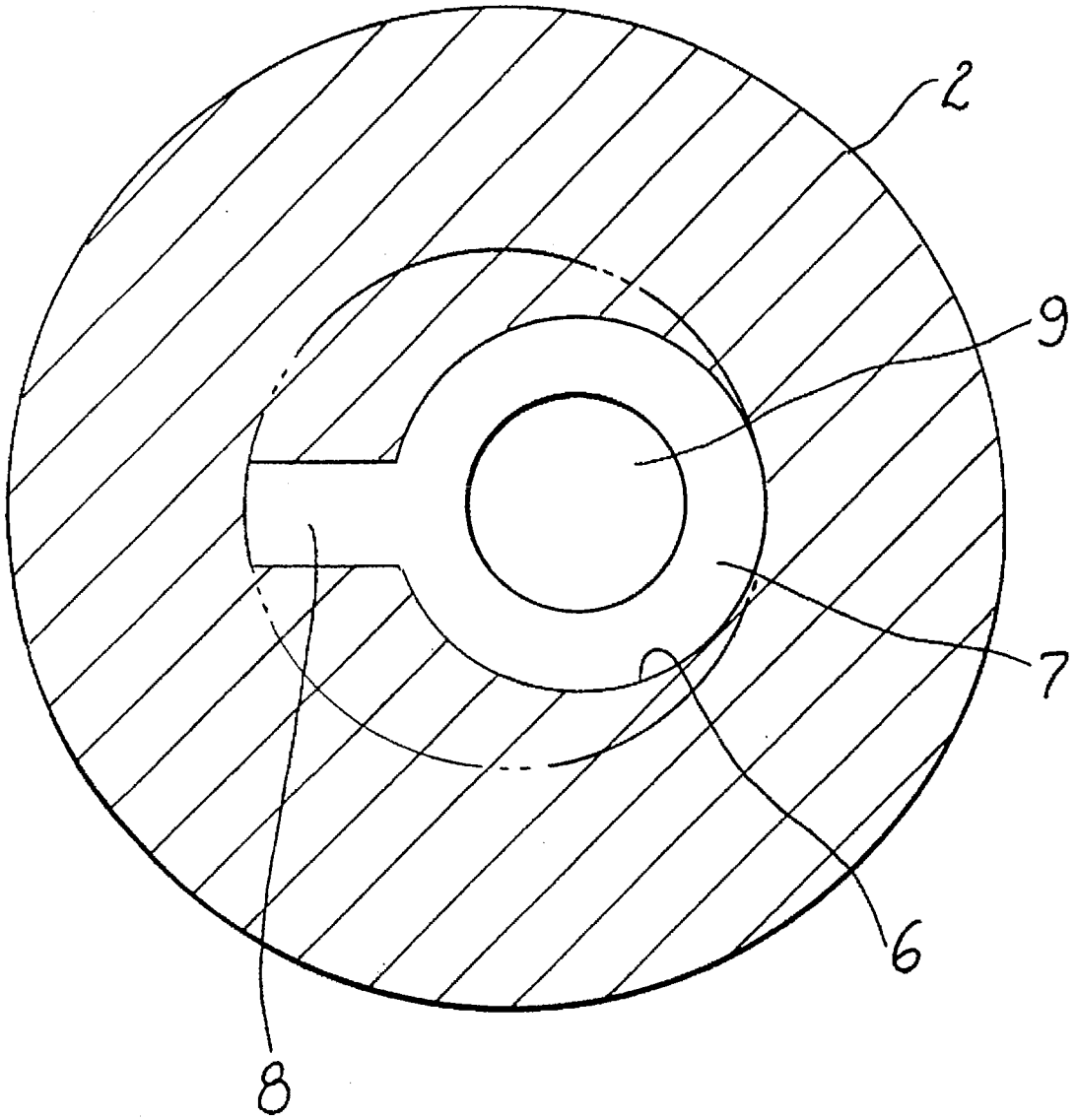
FIG. 8 is an enlarged transverse sectional view showing a valve chamber portion of the ball-point pen refill shown in FIG. 6.

FIGS. 6 to 8 show a second embodiment of the present invention. Initially, FIGS. 6 and 7 show a refill 40 for a ball-point pen of the present invention. The refill 40 includes a joint 2 composed of a front pipe portion 3 and a rear pipe portion 5 with a flange-like step portion 4 therebetween. A pipe portion 43 of a tip 42 holding a tip ball **42*a* at the front end thereof is secured in an inside hollow 11 in the front end of the front pipe portion 3**.

The inside hollow 11 is composed of front and rear tip fitting hollow sections **11*a* and 11*b*. A projected engaging portion 41 is formed as necessary on the peripheral side of the pipe portion 43 of the tip 42 so that the tip 42 is caught in biting fit by the rear tip fitting hollow sections 11*b***.

The tip ball **42*a* is received by a seat having channels 42*b* allowing ink to flow in and held by a press-bent edge so that the ball 42*a* can roll while substantially abutting against the seat. A spring 44 is inserted in the inside hollow of the tip 42 while the rear end of the pipe portion 43 of the tip is properly press-bent inward so that the rear end of the spring 44** will not come out.

Provided in the front part of the spring 44 is a straight rod portion **44*a* whose front end pressingly abuts against the backside of the tip ball 42*a*. The tip ball 42*a* is intimately pressed by the abutting force against the internal edge of the ball holding portion (formed by such as pressing) in the tip 42**.

A valve chamber 6 is provided in the rear of the inner hollow 11 in such a manner that the axis of the chamber 6 is off that of the tip 42. Formed in the rear end of the valve chamber 6 is a tapered or spherical ball valve seat 7 which is connected with conduit 9 (see FIG. 8). A groove 8 which allows ink to flow in is formed on one side of the inner wall of the valve chamber 6. A ball valve 10 is idly put in the valve chamber 6 and abuts offset against the rear edge of the pipe portion 43 of the tip 42 when the tip 42 is oriented downward, so that the ink flowed through the groove 8 from the conduit 9 will flow into the inside hollow of the tip 42.

The rear pipe portion 5 is extended rearward from the step portion 4 of the joint 2. A tubular ink reservoir 16 is squeezed and fixed on the outside periphery of the rear pipe portion 5 with its front end abutting against the rear side of the step portion 4, so that the inside hollow of the ink reservoir 16 communicates with the conduit 9 of the joint 2. Ink reservoir 16 is filled with oil having excellent resistance to dryness. A greasy ink follower 18 which is able to move following the consumption of the ink 17 is filled in contact with the rear end surface of the ink. Here, the ink reservoir 16 is formed by, for example, a transparent PP resin molding and the like. The inner surface of the ink reservoir 16 is applied with silicone and the like, so as to enhance the clear draining property. Alternatively, it is possible to form the ink reservoir with a material having a good draining property. The ink follower 18 may be composed of a solid material such as a silicone rubber and the like. The ink reservoir 16 may be formed integrally with the joint 2.

In the second embodiment, in a case where the tip 42 is oriented upward as shown in FIG. 6, the ball valve 10 is placed on the ball valve seat 7 in the valve chamber 6 to hermetically close the conduit 9. As a result, even if the pen is used for writing with its tip up and the ink immediately below the tip ball 42*a* in the tip is used up, the ball valve 10 functions as a backward-flow preventing valve so that the ink head is prevented from acting downward thereby preventing backward leakage of ink. More clearly, if the pen without any ball valve for preventing backward-flow is used for writing with its tip oriented upward, the air enters the tip from the clearance between the tip ball and the edge of the tip ball holder and consequently, the ink flows backward and leaks due to the self-weight of ink. On the contrary, according to the present invention, since the ball valve partitions the ink space into the upper and lower spaces by the ball valve, the ink below the ball valve is suspended and will not flow down to leak. In other words, if the ink below the ball valve would move downward or flow rearward of the pen, a negative pressure arises and acts on the topmost end of the ink and this prohibits the movement of the ink below the ball valve. Accordingly, ink will immediately flow out when the tip 42 is turned down after the upward-writing, so that it is possible to prevent unclear traces of writing. (In this connection, if the pen without any ball valve is used for writing with its tip up, the weight of ink acts in the backward leakage direction, the air is sucked from the tip opening. As a result, when the writing position is changed from upward-writing to downward-writing, ink will not follow immediately to create unsharp writing traces.)

As shown in FIG. 7, when the pen is used with its tip 42 downward, the ball valve 10 abuts offset against the press-bent portion 45 at the rear end of the tip 42 while the groove 8 which allows ink to flow into the tip 42 is provided. Therefore, the ink 17 flowed through the conduit 9 from the ink reservoir 16 and stored in the valve chamber 6 passes through the groove 8 so as to be led up to the backside of the tip ball 42*a*.

In this embodiment, when the pen tip is in free position, the rod portion 44*a* urges the tip ball 42*a* into intimate contact with the inner edge of the tip holding portion. Hence, the forward leakage of ink can be prevented. As the pen is used, the tip ball 42*a* is slightly pressed backward, whereby a clearance is created which allows ink to flow out. In consequence, as the tip ball 42*a* is rolled in writing, ink smoothly flows in a proper amount to create dense writing traces free from blotting.

In the embodiment, a plurality of channels 42*b* are disposed on immediately inner side of the tip ball 42*a* (more specifically, a plurality of ink flowing channels penetrating toward the tip-inside hollow are provided for the seat for the tip ball) with a rod portion 44*a* penetrated through a center hole in the center of channels 42*b*. The ink inside the tip 42 is introduced up to the back side of the tip ball 42*a* through the ink flowing channels as well as clearance between the wall of the center hole and the rod portion 44*a*.

Figure 9:
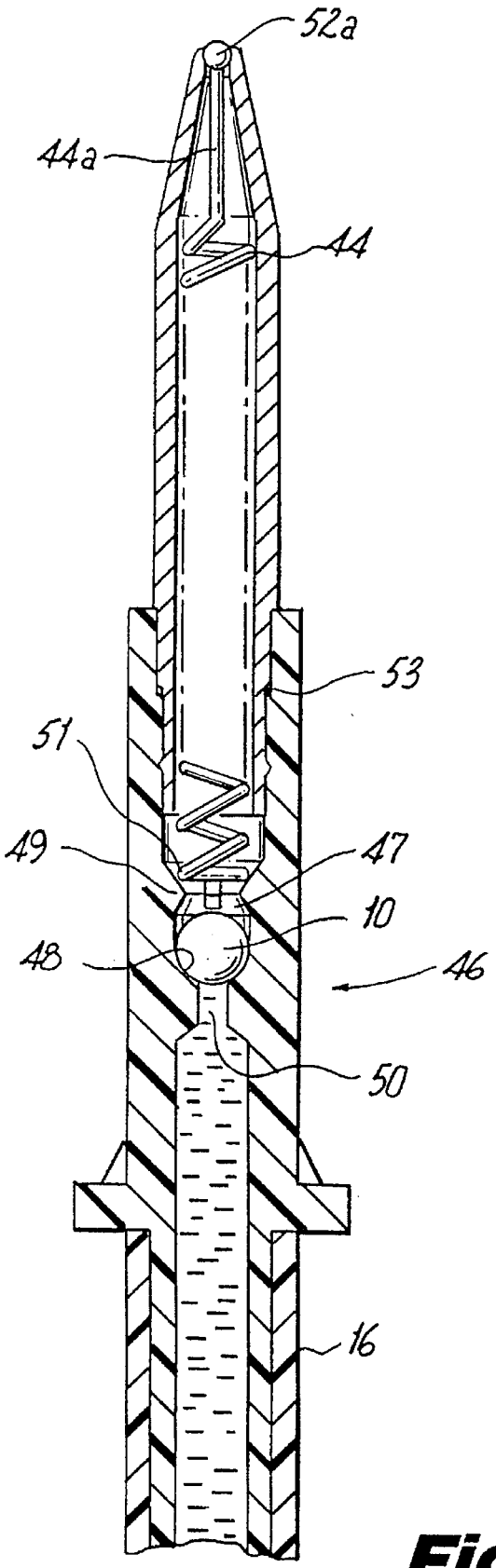
FIG. 9 is a vertical sectional view showing an overall feature of a ball-point pen refill with its tip oriented upward in accordance with a third embodiment of the present invention.

FIG. 9 shows a third embodiment of the present invention. Because this embodiment is similar to the second embodiment, only different features from those of the second embodiment will be described. Initially, a joint 46 is integrally molded with an elastically deformable synthetic resin and has a tip fitting hole 53 and a valve chamber 47 in the rear of the hole. Provided at the rear end of the valve chamber 47 is a tapered or spherical ball valve seat 48. A required number of projecting ribs 49 are disposed on the front side peripheral wall of the valve chamber A conduit 50 communicating with the ball valve seat 48 is formed in the rear of the valve chamber 47. A ball valve 10 is inserted into the valve chamber 47 by elastically deforming the projecting rib 49 so that the ball valve 10 may be idly held and cannot fall out. Here, the ball valve 10 abuts against the projecting ribs, between which ink introducing channels are formed. The rear end of a spring 44 abuts against a step portion 51 at the front edge of the projecting ribs 49 while the front end of a rod portion 44*a* urges the rear side of the a tip ball 52*a*.

In this arrangement, when the tip 52 is oriented downward, the ball valve 10 is abutted against the rear edge of the projecting ribs 49, thereby enabling ink to flow up to the rear side of the tip ball 52*a*, through the conduit 50, the valve chamber 47, the ink introducing channels defined between projecting ribs 49 and the inside hollow of the tip 52.

Hence, in the third embodiment, when the tip 52 is oriented upward as shown in FIG. 9, the ball valve 10 is brought into intimate contact with the ball valve seat 48 in the valve chamber 47 to hermetically close the conduit 50. As a result, even if the pen is used for writing with its tip up and the ink immediately below the tip ball 52*a* in the tip is used up, ink will not flow backward. When the tip 52 is oriented downward, the ball valve 10 abuts against the rear edge of the projecting ribs 49 and the conduit 50 is made open. The ink supplied through the conduit 50 from the ink reservoir 16 and stored in the valve chamber 47 is introduced up to the rear side of the tip ball 52*a* by way of the ink introducing channels defined between the projecting ribs 49. Other operations are the same as those in the second embodiment.

The structure of the second embodiment does not have any projecting ribs which, as formed in the third embodiment, keep the ball valve from being falling out, therefore, the mold accuracy and molding conditions in molding the joint 2 can be eased. In contrast to this, since the projecting ribs are to be created in the form of undercut upon the separation of the mold, it is difficult to create the molding with accuracy. Further, since the configuration with no projecting ribs allows the ball valve to be fitted easily into the valve chamber, the second embodiment is advantageous for the machine-assembling. There may be a fear or problem of damaging the projecting ribs as to the third embodiment since the ball valve is inserted relying on the property of resilient deformation of the projecting ribs.

On the other hand, in the second embodiment, the rear edge of the tip 42 must be caulked or press-formed so as to prevent the spring 44 from falling out. Therefore, the second embodiment is less advantageous than the third embodiment because this forming process requires more time and labor.

Figure 10:
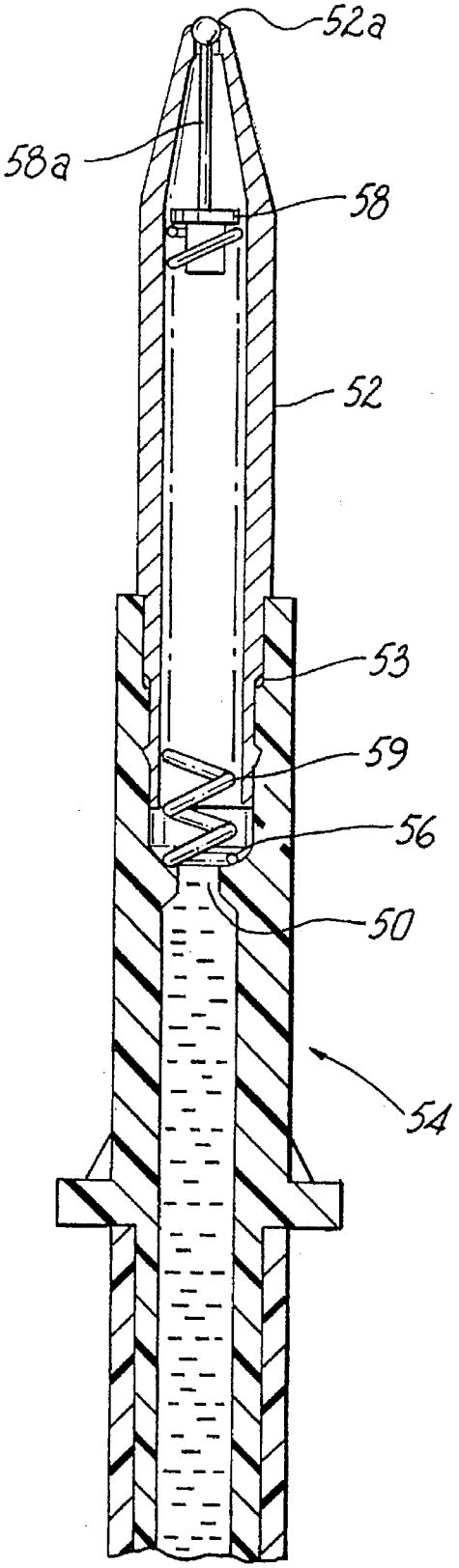
FIG. 10 is a vertical sectional view showing an overall feature of a ball-point pen refill with its tip oriented upward in accordance with a fourth embodiment of the present invention.

FIG. 10 shows a fourth embodiment of the present invention. Because this embodiment is basically the same as the above-described second embodiment, only different features will be described hereinafter.

A spring 59 inserted in a tip 52 has a seat at its front end for a pressing member 58 having a rod shaft 58*a* in the forward portion thereof. The front end of the rod shaft 58*a* pressingly abuts against the rear side of a tip ball 52*a*. A joint 54 has a step portion 56 formed thereinside for the other end of the spring 59.

That is, the provision of the pressing member 58 separately in the front of the spring 59 can impart improved flexibility or moving performance to the rod shaft 58*a*. Further, this structure allows choice of materials and features of the abutting portion against the tip ball 52*a* and therefore makes it possible to properly adjust the frictional resistance of that portion, thereby establishing a comfortable feeling with writing.

Figure 11:
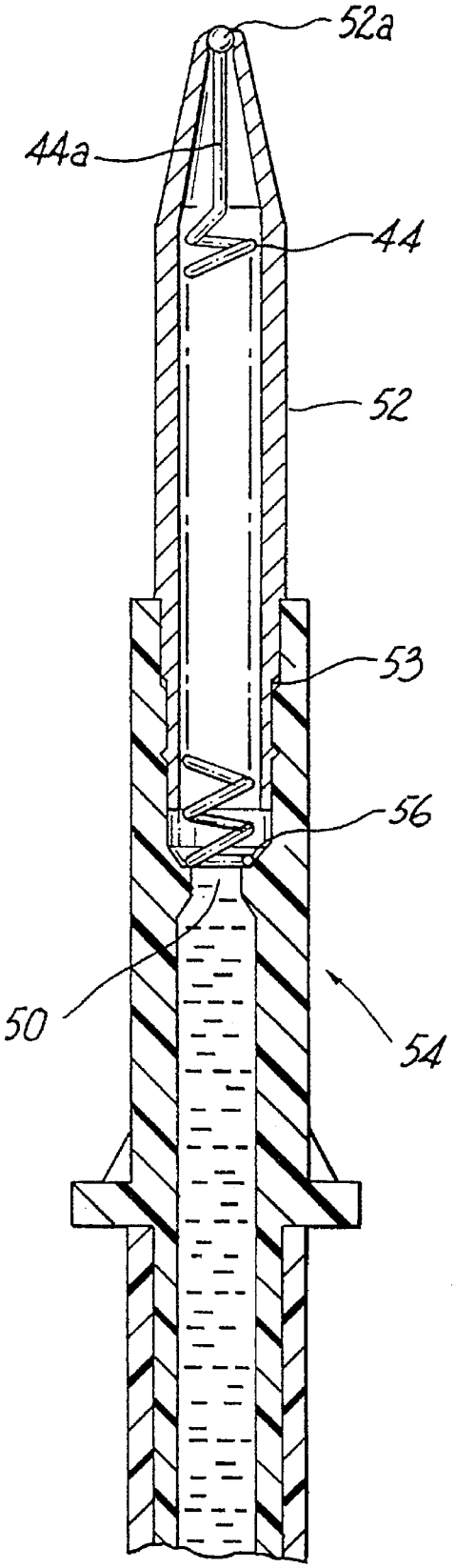
FIG. 11 is a vertical sectional view showing an overall feature of a ball-point pen refill with its tip oriented upward in accordance with a fifth embodiment of the present invention.

FIG. 11 shows a fifth embodiment of the present invention. Because this embodiment is basically the same as the above-described second embodiment, only different features will be described hereinafter.

A spring 44 has a straight rod portion 44*a* formed in the front end thereof. Alternatively, the spring 44 may have a tapered winding wire portion formed along the tapered inside wall in the front part of a tip 52. Further, since the inside hollow of a typical tip is drilled in the form of a stepped hole, it is possible to form the front part of the spring with a stepped winding wire portion which is reduced in diameter along the wall of the stepped hole. As another alternative, the front end of the winding portion may be made to abut against the tip ball. All of these variations are not illustrated here.

That is, since the rod portion 44*a* is integrally formed with the winding wire portion of the spring 44, this configuration is advantageous in view of cost. The provision of the winding wire portion that reduces in its diameter step-wise along the stepped inside wall of the inside hollow of the tip 52, makes the rod portion stable on the axis of the tip, whereby it is possible to reduce imbalance of ink flow as well as to stabilize the contacting resistance against the tip ball.

Further, since the tip ball 52*a* is always brought into intimate contact with inner edge of the tip holding portion, the tip portion will never dry, thereby it is possible to prevent occurrence of unclear traces of writing. There is a fear that repeated writings with the tip up may cause the air to pass into the tip inside and accumulate therein, therefore this structure presents less efficient than those illustrated in the second and third embodiments. Nevertheless, it is possible to compensate for this drawback by a proper combination of the tip ball 52*a* and compositions of ink and ink follower used. That is, by selecting the combination properly, it is possible to prevent the air from entering even when the pen is used with its tip up or receives some impacts, and thereby backward leaking and unclear traces in writing can be prevented in practical use.

Any of the ball-point pen refills in accordance with the second to fifth embodiment set forth can be mounted, like the ball pen-point pen refill of the first embodiment, to the knocking type ball-point pen shown in FIGS. 3 to 5.

As has been apparent from the second to fifth embodiments of the present invention it is possible to provide a ball-point pen of, for example, knocking type which, without need of any cap, allows its writing tip to project and retract at the front barrel opening and can create dense writing traces free from blotting and unevenness in spite of using a low viscosity oily ink having good resistance to dryness.

Further, the embodiments of the present invention can prevent the forward and backward leakage which would occur due to the low viscosity of ink when the pen is used in its tip up or receives knocking or any other outside impacts. As a result, it is possible to prevent occurrence of accidents such as dirtying the barrel inside, hands or clothes and the like. Further, it is possible to prevent unclear traces of writing. Moreover, since the tip ball is made in intimate contact with the tip holding portion when the pen is out of use, it is possible to effectively prevent unclear traces of writing due to the drying with the passage of time.

What is claimed is:

1. A ball-point pen comprising:

a barrel cylinder for holding a ball-point pen refill; and a ball-point pen refill accommodated in said barrel cylinder, said refill comprising:

a hollow tip with a tip ball held in a holding portion at the front end thereof, said tip further including a rear end having a rearmost press-bent portion;

an ink reservoir which gores low-viscosity oily ink having excellent resistance to dryness and has an ink follower provided in the rear end of said ink reservoir; and a joint disposed between said tip and said ink reservoir and having an inside hollow, said joint comprising; a ball valve; a valve chamber loosely holding said bail valve therein and communicating with said rear end of said tip; a ball valve seat disposed on the rear side of said valve chamber; and a conduit disposed in the rear side of said ball valve seat and providing communication between said valve chamber and said ink reservoir;

wherein;

said valve chamber is formed to permit said ball valve to rest alternately on said press-bent portion of said tip and said ball valve seat;

said valve chamber is formed and positioned such that said ball valve allows ink to flow to said tip when said ball valve rests on said press-bent portion of said tip; and said ball valve hermetically seals said valve chamber in order to prevent backward flow of ink when said ball valve rests on said ball valve seat.

2. The ball-point pen according to claim 1, wherein:

said ball point pen, said tip, and said joint each have a longitudinal axis;

said valve chamber has a side wall having a groove therein, said groove extending parallel to the longitudinal axis of said ball-point pen;

said conduit is disposed eccentrically relative to the axis of said joint; and upon writing, said ball valve abuts said press-bent portion of said tip offset from the axis of said tip to thereby establish an ink flowing passage.

3. The ball-point pen according to claim 1, wherein said low-viscosity oily ink has thixotropic property.

4. The ball-point pen according to claim 1, wherein:

said tip has a longitudinal axis; and said valve chamber has a longitudinal axis offset from said longitudinal axis of said tip so that ink can flow past said ball valve and through said tip when said ball valve rests on said press-bent portion of said tip.

5. A ball-point pen comprising:

a barrel cylinder for holding a ball-point pen refill; and a ball-point pen refill accommodated in said barrel cylinder and comprising:

a tip having a front opening, a tip ball, a rear end having a rearmost press-bent portion, and a spring urging said tip ball into intimate contact with the inside edge of a ball holding portion at the front end of said tip to close said front opening, said holding portion further including a plurality of ink flowing channels defined therein adjacent the end of said tip ball being urged by said spring;

an ink reservoir which stores low-viscosity oily ink having excellent resistance to dryness and has an ink follower provided in the rear end of said ink reservoir; and a joint disposed between said tip and said ink reservoir and having an inside hollow, said joint comprising: a ball valve; a valve chamber loosely holding said ball valve therein, and communicating with said rear end of said tip; a ball valve seat disposed on the rear side of said valve chamber; and a conduit disposed in the rear side of said ball valve seat and providing communication between said valve chamber and said ink reservoir;

wherein:

said ball valve alternately rests on said press-bent portion of said tip to allow ink to flow to said tip and on said ball valve seat to hermetically seal said valve chamber in order to prevent backward flow of ink; and at the time of writing, said tip ball is pressed inward against the resiliency of said spring m release the intimately contacting state between said tip ball and said ball holding portion and thereby allow ink to flow through said ink flowing channels and out said front opening.

6. The ball-point pen according to claim 5, wherein said valve chamber has a groove portion on one side wall thereof extending in parallel with the axis of said ball-point pen and said conduit is disposed eccentrically relative to the axis of said inside hollow of said joint, whereby, upon writing, said ball valve abuts offset against the rear edge of said tip establishing an ink flowing passage.

7. The ball-point pen according to claim 5, wherein said low-viscosity oily ink has thixotropy.

8. The ball-point pen according to claim 5, wherein said spring has a straight rod portion which presses said tip ball.

9. The ball-point pen according to claim 5, wherein said spring is composed of a coil spring and a pressing member having a straight rod portion which presses said tip ball.

10. The ball-point pen according to claim 5, wherein said joint further has a step portion on the outer peripheral side thereof while said barrel cylinder further has a step portion formed on the inner peripheral side thereof and a coil spring is interposed between said step portions to continuously urge said ball-point pen refill rearward so that the front part of said tip may be projected and retracted through a front end opening of said barrel cylinder by moving said ball-point pen refill in axial directions relative to said barrel cylinder.

11. A ball-point pen comprising:

a barrel cylinder for holding a ball-point pen refill; and a ball-point pen refill accommodated in said barrel cylinder and comprising:

a hollow tip having a front opening, a spring, a tip ball held in a holding portion at the from end of said tip by said spring, and a rear end through which a rear portion of said spring extends, said holding portion further including a plurality of flowing channels defined therein adjacent the end of said tip ball being urged by said spring;

an ink reservoir which stores low-viscosity oily ink having excellent resistance to dryness and has an ink follower provided in the rear end of said ink reservoir; and a joint disposed between said tip and said ink reservoir and having an inside hollow, said joint comprising: a ball valve; a valve chamber loosely holding said ball valve therein and communicating with said rear end of said tip, said valve chamber having a plurality of resiliently deformable inwardly-projecting ribs at a front side of said valve chamber adjacent said rear end of said tip, said rear portion of said spring abutting said ribs; a ball valve seat disposed on the rear side of said valve chamber; and a conduit disposed in the rear side of said ball valve seat and providing communication between said valve chamber and said ink reservoir;

wherein:

said ball valve alternately rests on said projecting ribs to allow ink to flow to said tip and on said ball valve seat to hermetically seal said valve chamber in order to prevent backward flow of ink; and at the time of writing, said tip ball is pressed inward against the resiliency of said spring to release the intimately contacting state between said tip ball and said ball holding portion and thereby allow ink to flow through said ink flowing channels and out said front opening of said tip.

* * * * *